US011565841B2

(12) United States Patent
Li

(10) Patent No.: US 11,565,841 B2
(45) Date of Patent: Jan. 31, 2023

(54) VACUUM SEALING MACHINE

(71) Applicant: Qincan Li, Guangdong Province (CN)

(72) Inventor: Qincan Li, Guangdong Province (CN)

(73) Assignee: Bonsen Electronics Limited, Guangdong (CN)

( * ) Notice: Subject to any disclaimer, the term of this patent is extended or adjusted under 35 U.S.C. 154(b) by 37 days.

(21) Appl. No.: 17/329,243

(22) Filed: May 25, 2021

(65) Prior Publication Data

US 2022/0380074 A1 Dec. 1, 2022

(51) Int. Cl.
*B65B 31/06* (2006.01)
*B65B 51/30* (2006.01)
*B65B 31/02* (2006.01)

(52) U.S. Cl.
CPC ..... *B65B 31/06* (2013.01); *B65B 31/024* (2013.01); *B65B 51/30* (2013.01)

(58) Field of Classification Search
CPC ..... B65B 31/06; B65B 31/024; B65B 31/048; B65B 31/04; B65B 31/043; B65B 51/10; B65B 51/146; B29C 66/82421
See application file for complete search history.

(56) References Cited

U.S. PATENT DOCUMENTS 5,177,937 A * 1/1993 Alden ..... B29C 66/9141 53/76
6,256,968 B1 * 7/2001 Kristen ..... F04B 49/022 53/512
6,694,710 B2 * 2/2004 Wang ..... B65B 31/06 53/88
7,204,067 B2 * 4/2007 Baptista ..... B65B 31/046 53/512
7,490,452 B2 * 2/2009 Alipour ..... B29C 66/43121 53/434
9,550,595 B2 * 1/2017 Steidele ..... B65B 31/024
2005/0011166 A1 * 1/2005 Germano ..... B65B 31/047 53/512
2005/0108990 A1 * 5/2005 Kahn ..... B65B 31/06 53/374.9
2010/0095638 A1 * 4/2010 Zakowski ..... B65B 31/046 53/511
2021/0016910 A1 * 1/2021 Ye ..... B65B 31/048

* cited by examiner

*Primary Examiner* — Andrew M Tecco
*Assistant Examiner* — Nicholas E Igbokwe

(57) ABSTRACT

The utility model discloses a vacuum sealing machine. The vacuum sealing machine comprises a base body, a bottom box, a bag opening heat sealing device, a vacuumizing device and a bag feeding induction mechanism, wherein the bottom box is arranged below the base body; the bag opening heat sealing device and a vacuumizing groove are correspondingly arranged on the connecting faces of the base body and the bottom box; the vacuumizing device communicates with the vacuumizing groove through a pipeline; and the bag feeding induction mechanism is arranged on the base body and positioned above the vacuumizing groove. According to the vacuum sealing machine, the bag feeding induction mechanism is arranged above the vacuumizing groove, so that detection of the bag feeding induction mechanism is stable and reliable, and the bag feeding induction mechanism is not prone to being damaged; and the vacuum sealing machine is simple in structure and low in cost.

8 Claims, 4 Drawing Sheets

VACUUM SEALING MACHINE

TECHNICAL FIELD

The utility model relates to the technical field of sealing machines, and particularly relates to a vacuum sealing machine.

BACKGROUND ART

A bag body detection element is arranged in a vacuumizing groove of the vacuum sealing machine. After a bag opening of a vacuum packaging bag is inserted into the vacuumizing groove, the bag body is detected through the bag body detection element, and a control circuit automatically starts a vacuumizing device and a bag opening heat sealing device to achieve full-automatic work. The bag body detection element arranged in the vacuumizing groove is prone to being polluted and corroded, the bag body detection element is prone to being damaged, thus the bag body detection function is caused to be invalid, and automatic work cannot be achieved, and therefore improvement is necessary.

SUMMARY OF THE UTILITY MODEL

The utility model provides a vacuum sealing machine aiming at solving the defects of the prior art. A bag feeding induction mechanism is stable and reliable in detection and is not easy to damage.

The technical scheme adopted by the utility model is as follows: the vacuum sealing machine comprises a base body, a bottom box, a control circuit, a bag opening heat sealing device, a vacuumizing device and the bag feeding induction mechanism for inducing a bag body, wherein the bottom box is arranged below the base body; the bag opening heat sealing device and a vacuumizing groove are correspondingly arranged on the connecting surfaces of the base body and the bottom box; the control circuit is correspondingly connected to the bag feeding induction mechanism, the bag opening heat sealing device and the vacuumizing device; the vacuumizing device communicates with the vacuumizing groove through a pipeline; and the bag feeding induction mechanism is arranged on the base body and positioned above the vacuumizing groove.

Furthermore, the bottom surface of the base body is provided with the bag opening heat sealing device, the top surface of the bottom box is provided with the vacuumizing groove, and the bag opening heat sealing device is positioned on the front side of the vacuumizing groove when the base body is matched with the bottom box in a propping manner; the base body is provided with at least one upper switch chamber, the upper switch chamber is isolated from the vacuumizing groove in a sealing manner when the base body is matched with the bottom box in a propping manner, and each upper switch chamber is internally provided with one bag feeding induction mechanism which is positioned above the bottom box.

Compared with the prior art, the vacuum sealing machine has the advantages that the bag feeding induction mechanism is arranged above the vacuumizing groove, so that the bag feeding induction mechanism is stable and reliable in detection and is not easy to damage; and the vacuum sealing machine is simple in structure and low in cost.

DETAILED DESCRIPTION OF THE PREFERRED EMBODIMENT

Figure 1:
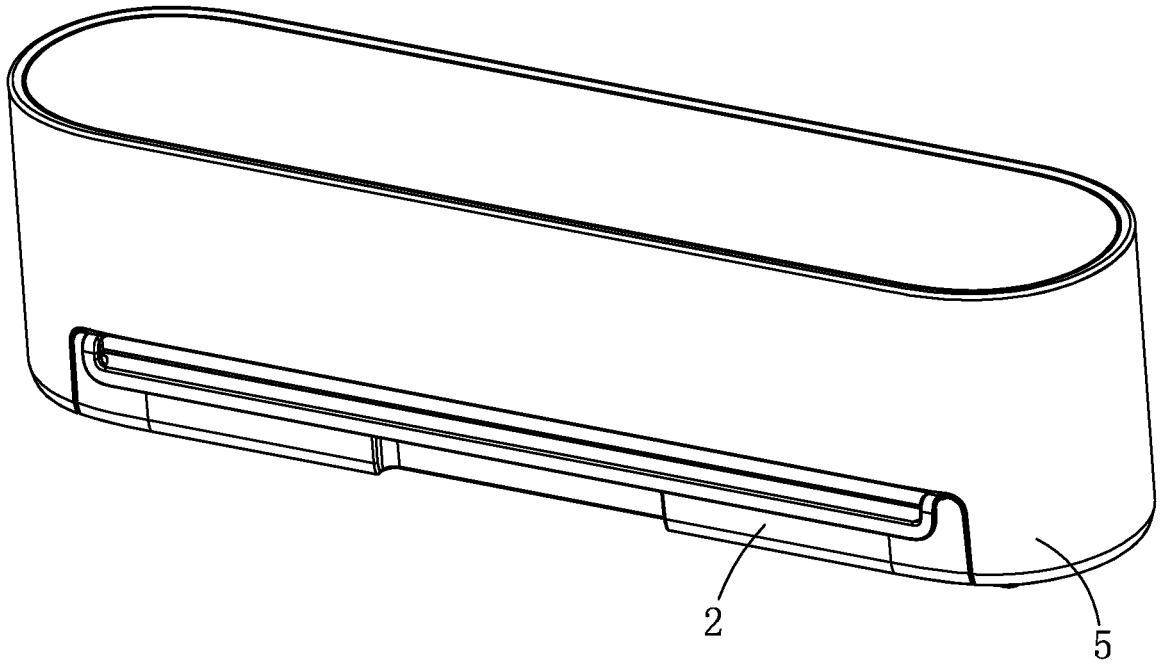
FIG. 1 is a structure view of the utility model.
Figure 2:
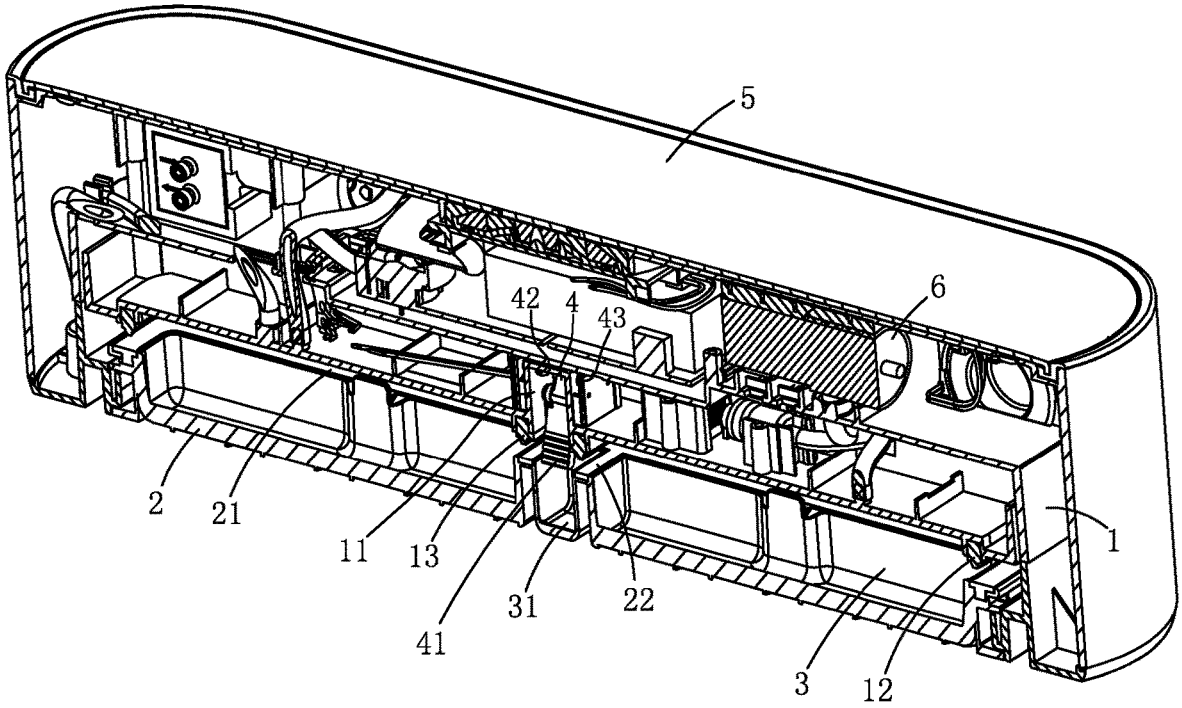
FIG. 2 is an internal structure view of the utility model.
Figure 3:
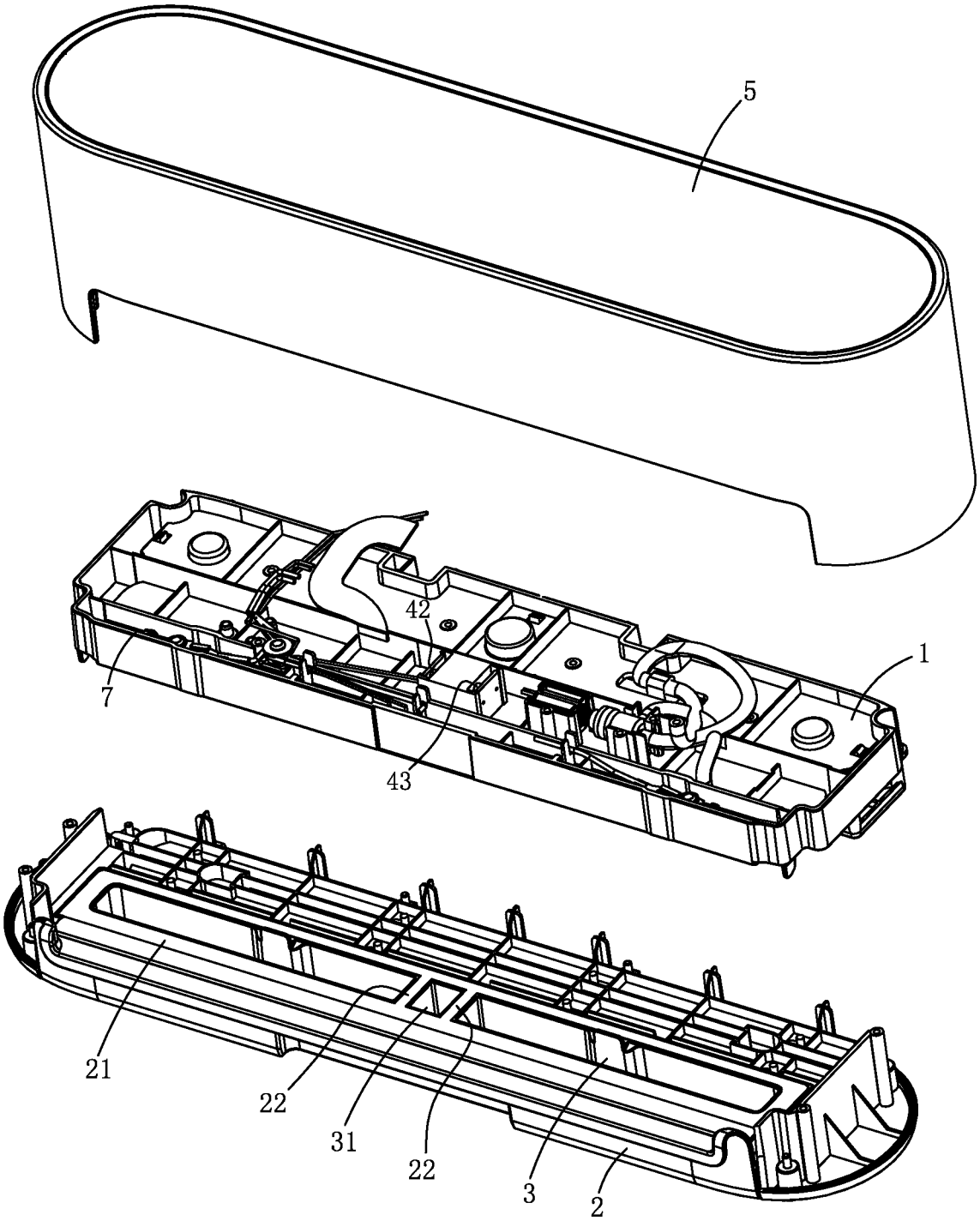
FIG. 3 is an exploded view of the utility model.
Figure 4:
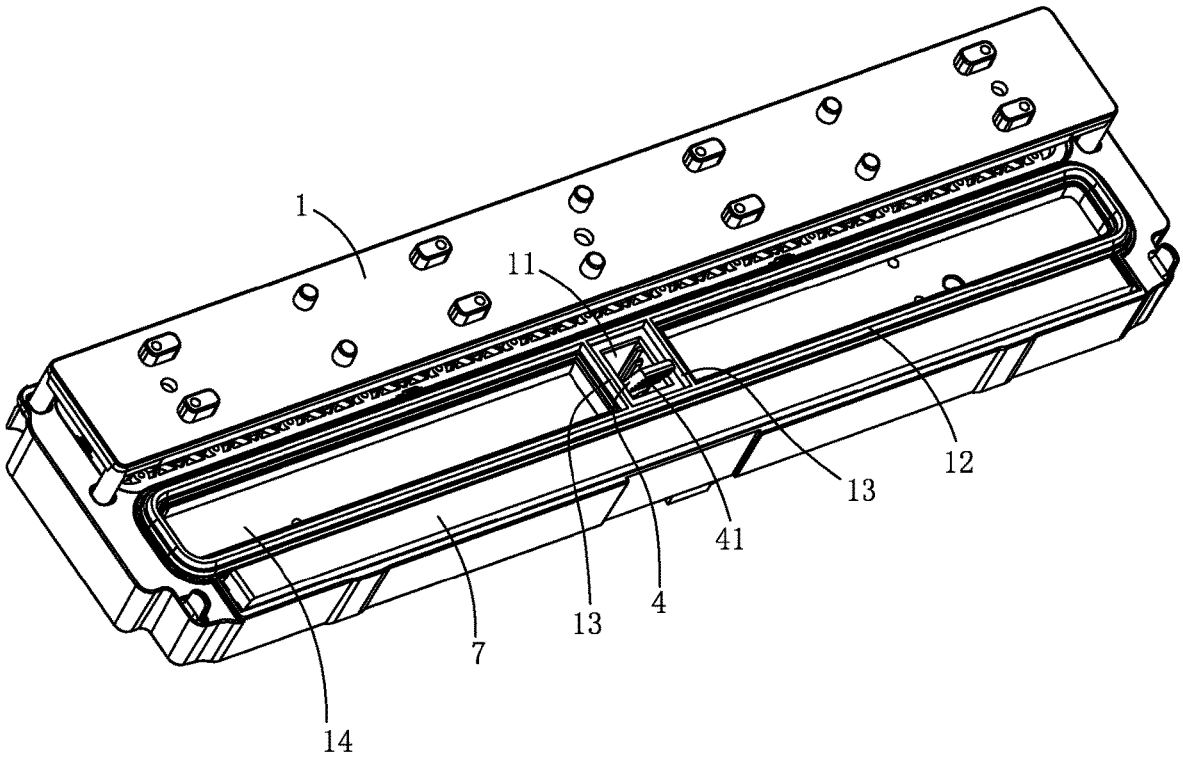
FIG. 4 is a structure view of the base body of the utility model.

The utility model provides a vacuum sealing machine. As shown in FIGS. 1 to 4, the vacuum sealing machine comprises a base body 1, a bottom box 2, a control circuit, a bag opening heat sealing device, a vacuumizing device and a bag feeding induction mechanism used for inducting a bag body, wherein the bottom box 2 is arranged below the base body 1; the bag opening heat sealing device and a vacuumizing groove 3 are correspondingly formed in the connecting faces of the base body 1 and the bottom box 2; the control circuit is correspondingly electrically connected to the bag feeding induction mechanism, the bag opening heat sealing device and the vacuumizing device; the vacuumizing device communicates with the vacuumizing groove 3 through a pipeline; and the bag feeding induction mechanism is arranged on the base body 1 and located above the vacuumizing groove 3. In the using process, liquid and other pollutants entering the vacuumizing groove 3 cannot make contact with the bag feeding induction mechanism, so that the bag feeding induction mechanism cannot be corroded or damaged.

The bag opening heat sealing device is arranged on the bottom surface of the base body 1; the vacuumizing groove 3 is formed in the top surface of the bottom box 2; the bag opening heat sealing device is positioned on the front side of the vacuumizing groove 3 when the base body 1 is matched with the bottom box 2 in a propping manner; the base body 1 is provided with at least one upper switch chamber 11; the upper switch chamber 11 is isolated from the vacuumizing groove 3 in a sealing manner when the base body 1 is matched with the bottom box 2 in a propping manner; and each upper switch chamber 11 is internally provided with one bag feeding induction mechanism which is located above the bottom box 2. The bag feeding induction mechanism is hidden in the upper switch chamber 11, so that the bag feeding induction mechanism is effectively protected.

The bag feeding induction mechanism is a non-contact electronic inductive switch or a mechanical inductive switch. For example, the bag feeding induction mechanism comprises a feeler lever 4 and an inductive switch; the bottom surface of the upper switch chamber 11 is opened to form an upper opening; the top surface and the side surface of the upper switch chamber 11 are sealed; the inductive switch is fixed to the upper part of the upper switch chamber 11, or the inductive switch is fixed to the top of the upper switch chamber 11; the inductive switch is electrically connected to a control circuit; the middle part or the upper part of the feeler lever 4 is pivoted to the upper part of the upper switch chamber 11; the inductive switch can be in trigger matching with the middle part or the upper part of the feeler lever 4 when the feeler lever 4 rotates; the lower part of the feeler lever 4 extends out from the upper opening and extends downwards into the vacuumizing groove 3; when the bag body is inserted, the bag body is propped against and pushes the lower part of the feeler lever 4, so that the upper part of the feeler lever 4 rotates, and the inductive switch is triggered; and the control circuit receives a switching signal of the inductive switch and controls the vacuumizing device and the bag opening heat sealing device to automatically start to work in sequence, so that the devices can automatically start to work after the bag opening is inserted into the vacuumizing groove 3.

Specifically, the inductive switch is a laser inductive switch electrically connected to the control circuit, and the laser inductive switch comprises a laser emitting element 42 and a laser receiving element 43 which are correspondingly fixed on two opposite sides of the upper switch chamber 11; when the laser inductive switch runs, a laser beam is generated between the laser emitting element 42 and the laser receiving element 43, and a moving path of the upper part of a feeler lever 4 intersects with the laser beam. The upper switch chamber 11 is provided with a left upper side wall and a right upper side wall, each of the transverse corresponding positions at the upper parts of the two upper sidewalls is provided with a mounting hole; the laser emitting element 42 is sealed and fixed in the mounting hole in one upper side wall, and the laser receiving element 43 is sealed and fixed in the mounting hole in the other upper side wall; and the head parts of the laser emitting element 42 and the laser receiving element 43 correspondingly extend into the upper switch chamber 11 and are oppositely arranged. Therefore, the induction is sensitive and accurate, and is not interfered by other factors.

The feeler lever 4 is a thin plate body; the upper middle part of the plate body is hinged with the upper middle part of the upper switch chamber 11; a plurality of concave-convex strips 41 which are arranged at intervals and transversely extend are arranged on the surface, facing the front side, of the plate body. Therefore, the bag opening is prevented from slipping relative to the feeler lever 4 after making a contact with the feeler lever 4, and the sensitivity and the accuracy of induction are improved.

An outer shell 5 is arranged at the outer part of the base body 1; the base body 1 is slidably mounted in the inner middle part or the inner middle part of an inner cavity of the outer shell 5; the bottom box 2 is lengthways movably inserted into the lower part of the inner cavity of the outer shell 5; a lower sealing strip 21 is mounted on the top surface of the bottom box 2 and surrounds the outer edge of the vacuumizing groove 3; an upper sealing strip 12 matched with the lower sealing strip 21 in shape is mounted on the bottom surface of the base body 1; and the upper sealing strip 12 is matched with the lower sealing strip 21 in a propping manner at least during vacuumizing. The vacuumizing device comprises a vacuumizing pump 6 installed on the outer shell 5, the vacuumizing pump 6 can also be installed on the base body 1 and is electrically connected to a control circuit, and the vacuumizing pump 6 is connected with the vacuumizing groove 3 through a pipeline, so that an air exhaust channel is formed. After the bag opening of the vacuum packaging bag is inserted into the vacuumizing groove 3, the vacuumizing pump 6 is started so that air in the vacuum packaging bag can be exhausted, and vacuum packaging is realized. The bag opening heat sealing device comprises an insulation seat which is fixed to the bottom part of the base body 1, and a heating element 7 which is fixed to the insulation seat and is electrically connected to the control circuit; the heating element 7 protrudes out of the bottom surface of the base body 1; at least one heat-resistant insulation layer covers the bottom surface of the heating element 7; the left side and the right side of the heating element 7 are correspondingly close to the left side and the right side of the base body 1; the heating element 7 is a heating chip or a heating wire; and the left side and the right side of the vacuumizing groove 3 are correspondingly close to the left side and the right side of the bottom box 2. The bag opening of the vacuum packaging bag is sealed in a hot melting manner through the bag opening heat sealing device.

An upper vacuumizing groove 14 matched with a vacuumizing groove 3 in shape is formed in the bottom surface of the base body 1; the vacuumizing groove 3 is matched with the upper vacuumizing groove 14 in a sealing manner when the base body 1 is matched with the bottom box 2 in a propping-pressing manner, and the upper side wall extends to the bottom surface of the upper vacuumizing groove 14; and the upper switch chamber 11 is isolated from the upper vacuumizing groove 14 in a sealing manner. A lower switch chamber 31 is arranged in the middle part of the vacuumizing groove 3, the top surface of the lower switch chamber 31 is opened to form a lower opening, the bottom surface and the side surface of the lower switch chamber 31 are sealed, the lower switch chamber 31 is arranged below the upper switch chamber 11, and the upper switch chamber 11 is connected and matched with the lower switch chamber 31 in a sealing manner during vacuumizing. The lower switch chamber 31 is provided with a lower left sidewall and a lower right sidewall which extend to the bottom of the vacuumizing groove 3; the vacuumizing groove 3 is divided into a left groove body and a right groove body by separating through the two lower sidewalls; a lower sealing strip 21 which surrounds the outer edge of the vacuumizing groove 3 is mounted on the top surface of the bottom box 2; two lower longitudinal sealing strip 22, which are arranged at an interval and correspondingly cover the top surfaces of the two lower sidewalls, are integrally formed in the middle part of the lower sealing strip 21; the upper switch chamber 11 is provided with an upper left sidewall and an upper right sidewall which are exposed from or protrude out of the bottom surface of the base body 1; an upper sealing strip 12 matched with the lower sealing strip 21 in a sealing manner is mounted on the bottom surface of the base body 1; two upper longitudinal sealing strips 13, which are arranged at an interval and correspondingly cover the bottom surfaces of the two upper sidewalls, are integrally formed in the middle part of the upper sealing strip 12; the upper longitudinal sealing strips 13 are matched with the corresponding lower longitudinal sealing strips 22 in an propping manner during vacuumizing; the upper switch chamber 11 and the lower switch chamber 31 are both isolated relative to the two groove bodies; the lower parts of the feeler lever 4 extend into the lower switch chamber 31 at least during vacuumizing; and the bag feeding induction mechanism is completely isolated from the vacuumizing groove 3 and is prevented from being damaged by the action of various factors.

The invention claimed is:

1. A vacuum sealing machine, comprising a base body, a bottom box, a bag opening heat sealing device, a vacuumizing device and a bag feeding induction mechanism for inducing a bag body, wherein the bottom box is arranged below the base body; the bag opening heat sealing device and a vacuumizing groove are correspondingly arranged on the base body and the bottom box; the bag opening heat sealing device and the vacuumizing device; the vacuumizing device communicates with the vacuumizing groove; the vacuum sealing machine is characterized in that the bag feeding induction mechanism is arranged on the base body and positioned above the vacuumizing groove;

wherein the bottom surface of base body is provided with the bag opening heat sealing device; the top surface of the bottom box is provided with the vacuumizing groove; when the base body and the bottom box are matched in a propping manner, the bag opening heat sealing device is positioned on the vacuumizing groove; the base body is provided with at least one upper switch chamber; the upper switch chamber is isolated from the vacuumizing groove in a sealing manner when the base body and the bottom box are matched in the propping manner; and the at least one upper switch chamber is internally provided with the bag feeding induction mechanism which is positioned above the bottom box;

wherein the bag feeding induction mechanism comprises a feeler lever and an inductive switch; the upper switch chamber is opened; a top surface and a side surface of the upper switch chamber are sealed; the inductive switch is fixed to an upper part or a top part of the upper switch chamber; a middle part or an upper part of the feeler lever is pivoted to the upper part of the upper switch chamber; the inductive switch contacts with a middle part or the upper part of the feeler lever; and a lower part of the feeler lever extends out from the upper opening an downwardly extends into the vacuumizing groove.

2. The vacuum sealing machine according to claim 1, wherein the inductive switch is a laser inductive switch; the laser inductive switch comprises a laser emitting element and a laser receiving element which are correspondingly fixed to two opposite sides of the upper switch chamber; a laser beam is generated between the laser emitting element and the laser receiving element when the laser inductive switch runs; and a moving path of the upper part of the feeler lever intersects the laser beam.

3. The vacuum sealing machine according to claim 2, wherein the upper switch chamber is provided an upper left sidewall and an upper right sidewall; the laser emitting element is sealed and fixed into one of the upper sidewalls, and the laser receiving element is sealed and fixed into the other upper sidewall; and the laser emitting element and the laser receiving element correspondingly extend into the upper switch chamber and are oppositely arranged.

4. The vacuum sealing machine according to claim 3, wherein an outer shell is arranged at an outer part of the base body, the base body is slidably mounted in the outer shell; the bottom box is lengthways movably inserted into an inner cavity of the outer shell; a lower sealing strip is mounted on the top surface of the bottom box and surrounds the vacuumizing groove; an upper sealing strip matched with the lower sealing strip in shape is mounted on the bottom surface of the base body; and the upper sealing strip is matched with the lower sealing strip in a propping manner at least during vacuumizing.

5. The vacuum sealing machine according to claim 4, wherein the vacuumizing device comprises a vacuumizing pump which is mounted at the outer shell or the base body; the bag opening heat sealing device is fixed to the bottom part of the base body, and a heating element protrudes out of the bottom surface of the base body; the heating element are correspondingly close to a left side and a right side of the base body; the heating element is a heating chip or a heating wire; and a left side and a right side of the vacuumizing groove are correspondingly close to a left side and a right side of the bottom box.

6. The vacuum sealing machine according to claim 5, wherein a lower switch chamber is arranged in the middle part of the vacuumizing groove; a top surface of the lower switch chamber is opened an upper opening and a bottom surface of the lower switch chamber is opened to form a lower opening; the bottom surface and a side surface of the lower switch chamber are sealed; the lower switch chamber is arranged below the upper switch chamber; the upper switch chamber and the lower switch chamber are connected and are matched in a sealing manner during vacuumizing; an upper vacuumizing groove matched with the vacuumizing groove in shape is formed in the bottom surface of the base body; the vacuumizing groove is in sealing matching with the upper vacuumizing groove when the base body is matched with the bottom box in a propping-pressing manner; an upper sidewall of the upper vacuumizing groove extends to a bottom surface of the upper vacuumizing groove; and the upper switch chamber is isolated from the upper vacuumizing groove in a sealing manner.

7. The vacuum sealing machine according to claim 6, wherein the vacuumizing groove is divided by separating through the two lower sidewalls; a lower sealing strip which surrounds the outer edge of the vacuumizing groove is mounted on the top surface of the bottom box; two lower longitudinal sealing strips, which are arranged at an interval and correspondingly cover two top surfaces of the two lower sidewalls, are integrally formed in the middle part of the lower sealing strip; the upper switch chamber is provided with an upper left sidewall and an upper right sidewall which are exposed from or protrude out of the bottom surface of the base body; an upper sealing strip matched with the lower sealing strip in a sealing manner is mounted on the bottom surface of the base body; two upper longitudinal sealing strips, which are arranged at an interval and correspondingly cover the bottom surfaces of the two upper sidewalls, are integrally formed in the middle part of the upper sealing strip; the upper longitudinal sealing strips are matched with the corresponding lower longitudinal sealing strips in an propping manner during vacuumizing; the upper switch chamber and the lower switch chamber are both isolated relative to the two groove bodies; and the lower part of the feeler lever extends into the lower switch chamber at least during vacuumizing.

8. The vacuum sealing machine according to claim 7, wherein the feeler lever is a thin plate body; an upper middle part of the plate body is hinged with an upper middle part of the upper switch chamber; and a plurality of concave-convex strips which are arranged at intervals and transversely extend are arranged on a surface, facing the front side, of the plate body.

* * * * *